US012145782B2

(12) United States Patent
Hong et al.

(10) Patent No.: US 12,145,782 B2
(45) Date of Patent: Nov. 19, 2024

(54) SEALING STRUCTURE AND MATERIAL CONTAINING DEVICE INCLUDING THE SAME

(71) Applicant: SAMSUNG ELECTRONICS CO., LTD., Suwon-si (KR)

(72) Inventors: Wooram Hong, Suwon-si (KR); Hyun Do Choi, Yongin-si (KR); Dal Heo, Yongin-si (KR); Youngchun Kwon, Yongin-si (KR); Hyukju Kwon, Uiwang-si (KR); Gahee Kim, Yongin-si (KR); Bosung Kim, Suwon-si (KR); Jeonghun Kim, Suwon-si (KR); Jin Woo Kim, Suwon-si (KR); Min Sik Park, Hwaseong-si (KR); Youngjin Park, Seoul (KR); Hyungtae Seo, Suwon-si (KR); Won Seok Oh, Suwon-si (KR); Dongseon Lee, Suwon-si (KR); Sangyoon Lee, Suwon-si (KR); Jaejun Chang, Gwacheon-si (KR); Jun-Won Jang, Seoul (KR); Hyunjeong Jeon, Suwon-si (KR); Joon-Kee Cho, Yongin-si (KR); Byung-Kwon Choi, Seongnam-si (KR); Won Je Choi, Suwon-si (KR); Younsuk Choi, Seongnam-si (KR); Taesin Ha, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/688,418

(22) Filed: Mar. 7, 2022

(65) Prior Publication Data

US 2023/0089079 A1 Mar. 23, 2023

(30) Foreign Application Priority Data

Sep. 17, 2021 (KR) ..... 10-2021-0124491

(51) Int. Cl.
*B65D 51/00* (2006.01)
*B65D 51/20* (2006.01)

(52) U.S. Cl.
CPC ..... *B65D 51/002* (2013.01); *B65D 51/20* (2013.01); *B65D 2251/0015* (2013.01); *B65D 2251/0093* (2013.01)

(58) Field of Classification Search
CPC ..... B65D 51/002; B65D 51/20; B65D 2251/0015; B65D 2251/0093
(Continued)

(56) References Cited

U.S. PATENT DOCUMENTS 3,749,274 A * 7/1973 Mele ..... B65F 1/1607 220/838
3,871,550 A * 3/1975 Chiappe ..... B65D 17/28 220/837
(Continued)

FOREIGN PATENT DOCUMENTS

EP 2426058 A1 * 3/2012 ..... B65D 17/166
JP 7-18614 Y2 5/1995
(Continued)

*Primary Examiner* — James N Smalley
(74) *Attorney, Agent, or Firm* — Sughrue Mion, PLLC

(57) ABSTRACT

A sealing structure may include a lid including a first lid face, a second lid face opposite to the first lid face, and a fragile area between the first lid face and the second lid face, a cover including a first cover face facing the second lid face and covering the fragile area and a second cover face opposite to the first cover face, wherein a first distance between the second lid face and the first cover face is substantially equal to or less than a second distance between
(Continued)

the first cover face and the second cover face, and a connector configured to connect the lid and the cover.

20 Claims, 14 Drawing Sheets

(58) Field of Classification Search
USPC ..... 215/247, 249
See application file for complete search history.

(56) References Cited

U.S. PATENT DOCUMENTS 3,982,658 A * 9/1976 Bozek ..... B65D 17/506 220/268
4,066,183 A * 1/1978 Armstrong ..... G01N 30/18 215/DIG. 4
4,138,033 A * 2/1979 Payne ..... B65D 47/2018 220/714
4,361,249 A * 11/1982 Tuneski ..... B65D 47/2018 220/714
4,441,624 A * 4/1984 Sokolowski ..... B65D 47/2018 220/255
5,096,082 A * 3/1992 Hoefler ..... B65D 17/4014 220/255
5,810,189 A * 9/1998 Baker ..... B65D 17/4014 220/269
6,216,340 B1 4/2001 Fassbind et al.
6,498,042 B1 12/2002 Wilson
6,651,305 B2 11/2003 Fassbind et al.
7,961,384 B2 6/2011 Pirsch
8,376,958 B2 2/2013 Larkin
8,387,810 B2 3/2013 Livingston et al.
8,475,577 B2 7/2013 Novosselov et al.
8,631,953 B2 * 1/2014 Pavlovic ..... B01L 3/50825 215/253
9,302,265 B2 4/2016 Birkner et al.
9,796,574 B2 10/2017 Frey et al.
9,815,601 B2 * 11/2017 Browne ..... A61J 1/1406
9,914,123 B2 3/2018 Young et al.
10,048,284 B2 8/2018 Muller et al.
10,168,256 B2 1/2019 Easton et al.
10,172,545 B2 1/2019 Philipak et al.
10,179,333 B2 1/2019 Pompa
10,308,381 B2 6/2019 Guggisberg et al.
2001/0013169 A1 8/2001 Fassbind et al.
2003/0192889 A1 10/2003 Chasteen et al.
2007/0291360 A1 12/2007 Pirsch
2008/0251489 A1 10/2008 Livingston et al.
2010/0124780 A1 5/2010 Larkin
2011/0232498 A1 9/2011 Novosselov et al.
2012/0103470 A1 5/2012 Terwilliger et al.
2012/0298665 A1 * 11/2012 Foucault ..... B01L 3/50825 220/254.5
2014/0322104 A1 10/2014 Philipak et al.
2014/0331618 A1 11/2014 Guggisberg et al.
2015/0238978 A1 8/2015 Muller et al.
2015/0300927 A1 10/2015 Easton et al.
2016/0023210 A1 1/2016 Birkner et al.
2016/0030286 A1 * 2/2016 Fazi ..... G21F 5/015 220/230
2016/0158749 A1 6/2016 Young et al.
2017/0080415 A1 3/2017 Pompa
2017/0113909 A1 4/2017 Frey et al.

FOREIGN PATENT DOCUMENTS

JP 8-301322 A 11/1996
JP 2602260 A 4/1997
JP 10-100691 A 4/1998
JP 2002-700 A 1/2002
JP 3761411 B2 3/2006
JP 5215873 B2 6/2013
JP 2020-74932 A 5/2020
KR 1993-0001157 Y1 3/1993
KR 10-2000-0031928 A 6/2000
KR 2001-0041666 A 5/2001
KR 20-0396193 Y1 9/2005
KR 20-0411882 Y1 3/2006
KR 10-1319416 B1 10/2013
KR 10-2014-0106366 A 9/2014
KR 10-2017-0109720 A 10/2017
KR 10-2018-0023213 A 3/2018
KR 10-1889340 B1 8/2018
WO WO-2010073010 A2 * 7/2010 ..... A61J 7/0023
WO WO-2012126511 A1 * 9/2012 ..... B65D 17/166

* cited by examiner

SEALING STRUCTURE AND MATERIAL CONTAINING DEVICE INCLUDING THE SAME

CROSS-REFERENCE TO RELATED APPLICATION

This application claims priority to Korean Patent Application No. 10-2021-0124491, filed on Sep. 17, 2021, in the Korean Intellectual Property Office, the disclosure of which is incorporated by reference herein in its entirety.

BACKGROUND

1. Field

The disclosure relates to a sealing structure and a material containing device including the same and, more specifically, to a sealing structure for sealing a container when extracting a sample out of the container or injecting a sample into the container and a material containing device including the same.

2. Description of Related Art

Techniques for sealing a container when extracting a sample out of the container or injecting a sample into the container are being developed. For example, a technique using a valve installed on a path from an outside of a container to an inside thereof may open or close the path by the valve when extracting or injecting a sample.

SUMMARY

One or more example embodiments may address at least the above problems and/or disadvantages and other disadvantages not described above. Also, the example embodiments are not required to overcome the disadvantages described above, and an example embodiment may not overcome any of the problems described above.

According to an aspect of an example embodiment, there is provided a sealing structure including: a lid including a first lid face, a second lid face opposite to the first lid face, and a fragile area between the first lid face and the second lid face; a cover including a first cover face facing the second lid face and covering the fragile area, and a second cover face opposite to the first cover face, wherein a first distance between the second lid face and the first cover face is substantially equal to or less than a second distance between the first cover face and the second cover face; and a connector configured to connect the lid and the cover.

The cover may further include: a first end portion; a second end portion opposite to the first end portion; and an extension extending along the second lid face between the first end portion and the second end portion.

The extension may be configured to deform based on the first end portion.

The cover may further include a seat connected to the second end portion and configured to contact the second lid face.

The second lid face and the seat are separated from each other by a gap therebetween.

The second lid face and the seat may be configured to be in contact with each other, and the second lid face and the seat may not be physically restrained to each other.

The cover may further include an adhesive portion provided between the second lid face and the seat, the adhesive portion being configured to bond the second lid face and the seat.

The connector may be positioned between the second lid face and the first cover face and the connector has a thickness smaller than the second distance between the first cover face and the second cover face.

The sealing structure may further include a protrusion protruding from the second lid face or the connector.

The cover may further include a coating layer provided on the first cover face.

The connector may include: a support structure provided on the second lid face; and an elastic body connected to the support structure and the second cover face.

The support structure may include: a wall portion extending from the second lid face in a first direction; and a base portion extending from the wall portion in a second direction intersecting with the first direction to be connected to the elastic body.

The connector may include a support structure provided on the second lid face, the support structure having a pivot to which the cover is rotatably connected.

The cover may further include: a first end portion; a second end portion opposite to the first end portion; an extension extending along the second lid face between the first end portion and the second end portion to be connected to the pivot; and a weight provided on the extension.

According to an aspect of an example embodiment, there is provided a sealing structure including: a lid including a first lid face, a second lid face opposite to the first lid face, a fragile area between the first lid face and the second lid face, and a first pole element provided in the fragile area and configured to exhibit a first polarity; and a cover including a first cover face connected to the second lid face, a second cover face opposite to the first cover face, and a second pole element configured to exhibit a second polarity opposite to the first polarity, wherein the first cover face faces the second lid face and overlaps the fragile area.

The lid and the cover may be formed of substantially a same material.

The lid may be formed of a first material and the cover is formed of a second material different from the first material.

The cover may further include: a first end portion connected to the second lid face; a second end portion opposite to the first end portion; and an extension extending along the second lid face between the first end portion and the second end portion, and configured to deform based on the first end portion.

According to an aspect of an example embodiment, there is provided a sealing structure including: a lid including a first lid face, a second lid face opposite to the first lid face, a fragile area between the first lid face and the second lid face, and a plurality of guides provided in the fragile area, wherein a pair of adjacent guides from among the plurality of guides form a channel.

The lid may be configured to elastically deform to have a first shape in which the plurality of guides contract and a second shape in which the plurality of guides expand.

BRIEF DESCRIPTION OF THE DRAWINGS

The above and/or other aspects will be more apparent by describing certain example embodiments with reference to the accompanying drawings, in which.

DETAILED DESCRIPTION

Figure 1:
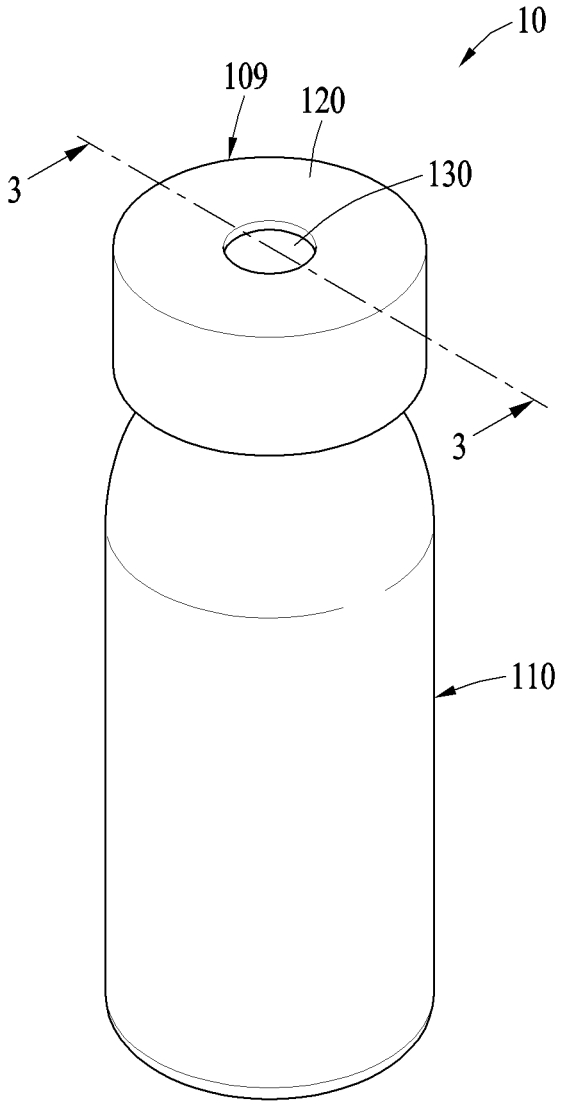
FIG. 1 is a perspective view of a material containing device including a sealing structure according to an example embodiment.
Figure 2:
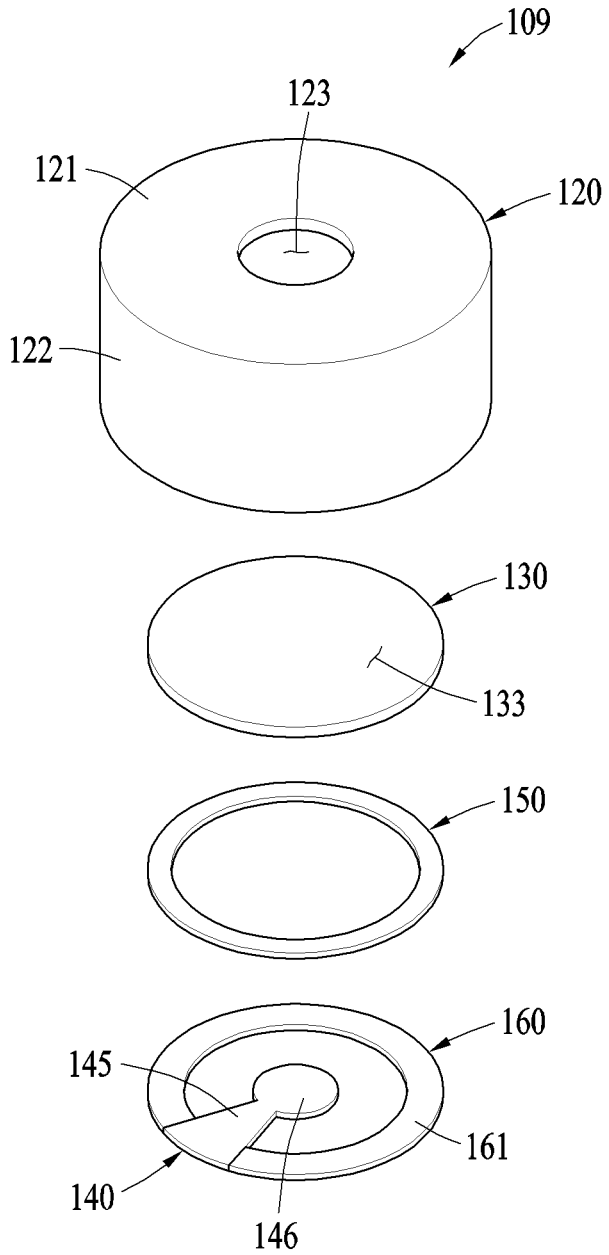
FIG. 2 is an exploded perspective view of the sealing structure of FIG. 1.

Hereinafter, example embodiments will be described in detail with reference to the accompanying drawings. However, various alterations and modifications may be made to the example embodiments. Here, the example embodiments are not construed as limited to the disclosure. The example embodiments should be understood to include all changes, equivalents, and replacements within the idea and the technical scope of the disclosure.

The terminology used herein is for the purpose of describing particular example embodiments only and is not to be limiting of the example embodiments. The singular forms "a", "an", and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

Unless otherwise defined, all terms including technical and scientific terms used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

When describing the example embodiments with reference to the accompanying drawings, like reference numerals refer to like constituent elements and a repeated description related thereto will be omitted. In the description of example embodiments, detailed description of well-known related structures or functions will be omitted when it is deemed that such description will cause ambiguous interpretation of the present disclosure.

Also, in the description of the components, terms such as first, second, A, B, (a), (b) or the like may be used herein when describing components of the present disclosure. These terms are used only for the purpose of discriminating one constituent element from another constituent element, and the nature, the sequences, or the orders of the constituent elements are not limited by the terms. When one constituent element is described as being "connected", "coupled", or "attached" to another constituent element, it should be understood that one constituent element can be connected or attached directly to another constituent element, and an intervening constituent element can also be "connected", "coupled", or "attached" to the constituent elements.

The same name may be used to describe an element included in the example embodiments described above and an element having a common function. Unless otherwise mentioned, the descriptions on the example embodiments may be applicable to the following example embodiments and thus, duplicated descriptions will be omitted for conciseness.

Referring to FIGS. 1 to 4, a material containing device 10 according to an example embodiment may be configured to contain a material. For example, a user may store a sample in the material containing device 10, cause a chemical reaction of the sample in the material containing device 10, or process the sample in the material containing device 10. During the storage, reaction, and processing of the sample, the user may sample a portion of the sample or add another material into the material containing device 10 while preventing the material from leaking from the material containing device 10.

The material containing device 10 may be applied to research and development or process in physics, chemistry, biology, and industry. For example, the user may extract the sample from the material containing device 10 using a manipulation instrument (e.g., a syringe) for physical fluid extraction or injection. In an example embodiment, the material containing device 10 may be a sealing component that accommodates a material in a solid, liquid, or gaseous state. For example, at least a portion of the material containing device 10 may be formed of glass or metal. In an example embodiment, the material containing device 10 may be a component used to prevent leakage of a reagent and/or sample remaining in a container (e.g., a container 110) when sampling a portion of multi-phase reagents and/or samples from the container or adding an additive into the container. For example, the material containing device 10 may include a gasket, an O-ring, a septum, and other sealing elements. In an example embodiment, the material containing device 10 may be a component used in research and development and industrial process or mass production facilities requiring material synthesis. In an example embodiment, the material containing device 10 may be a component that is also applied to medical, residential, cooking, home appliances, and other wearable devices requiring sealing of a material.

The material containing device 10 may include the container 110 and a sealing structure 109 configured to seal the container 110. The sealing structure 109 may include a cap 120, a lid 130, a cover 140, a connector 150, and a protrusion 160.

The container 110 may be configured to accommodate a material. For example, the container 110 may be a vial. The container 110 may include a body portion 111, a neck portion 112 having an opening 114, and a connecting portion 113 between the body portion 111 and the neck portion 112. The body portion 111, the neck portion 112, and the connecting portion 113 may be seamlessly integrally formed. The opening 114 may have a diameter of, for example, about 13 mm. In another example embodiment, the container 110 may include a body portion 111 and a neck portion 112, without a connecting portion 113, to form a substantially single cylindrical shape.

In an example embodiment, the body portion 111 may have a substantially cylindrical shape. In another example embodiment, the body portion 111 may be a three-dimensional body having a polygonal cross-section.

In an example embodiment, the neck portion 112 may include a first engaging portion 115 formed on an outer surface of the neck portion 112. For example, the first engaging portion 115 may include threads.

In an example embodiment, the container 110 may be formed of a glass material or a metal material.

The cap 120 may be configured to enclose at least a portion of the container 110. The cap 120 may include a first enclosure portion 121 enclosing at least a portion of the opening 114, and a second enclosure portion 122 enclosing at least a portion of the neck portion 112. The first enclosure portion 121 and the second enclosure portion 122 may be seamlessly integrally formed.

In an example embodiment, the first enclosure portion 121 may include an access opening 123 accessible by a manipulation instrument (e.g., a syringe) for injecting and/or extracting a material. The access opening 123 may be formed in the first enclosure portion 121. The access opening 123 may be substantially circular, for example. The access opening 123 may be formed to penetrate through the first enclosure portion 121. The access opening 123 may be positioned substantially in a central portion of the first enclosure portion 121.

In an example embodiment, the second enclosure portion 122 may include a second engaging portion 124 configured to engage with the first engaging portion 115. For example, the second engaging portion 124 may include threads. The second engaging portion 124 may be formed on an inner surface of the second enclosure portion 122. The second engaging portion 124 may be formed in a portion, of the second enclosure portion 122, apart from the first enclosure portion 121.

The lid 130 may be configured to seal the opening 114. The lid 130 may include a first lid face 131 (e.g., the top face of the lid 130), a second lid face 132 (e.g., the bottom face of the lid 130) opposite to the first lid face 131 and facing the opening 114, and a fragile area 133 configured to be at least partially broken between the first lid face 131 and the second lid face 132. The fragile area 133 may be at least partially broken, for example, by a manipulation instrument (e.g., a syringe) for injecting and/or extracting a material. When at least a portion of the fragile area 133 is broken, a perforation 134 may be formed in at least a portion of the fragile area 133 by the manipulation mechanism. The perforation 134 may have a diameter of, for example, about 1 mm.

In an example embodiment, the lid 130 may have a substantially circular or elliptical cross-section. In another example embodiment, the lid 130 may have a polygonal cross-section.

In an example embodiment, the lid 130 may be a septum. For example, the lid 130 may be formed of an elastic material.

In an example embodiment, the lid 130 may have any size appropriate for sealing the opening 114. For example, a distance between the first lid face 131 and the second lid face 132 (e.g., a thickness of the lid 130) may be in a range of about 1.5 mm to about 3.0 mm. An area of the first lid face 131 and an area of the second lid face 132 may be substantially equal to or greater than a size of the opening 114.

The cover 140 may be configured to cover at least a portion of the fragile area 133. For example, the cover 140 may be configured to cover the perforation 134 formed in the fragile area 133 when at least a portion of the fragile area 133 is broken. When the cover 140 covers the perforation 134, flow or transfer of the material between the inside and the outside of the container 110 through the perforation 134 may be substantially blocked. The cover 140 may include a first cover face 141 (e.g., the top face of the cover 140) facing the second lid face 132, and a second cover face 142 (e.g., the bottom face of the cover 140) opposite to the first cover face 141 and oriented toward the inside of the container 110.

In an example embodiment, the lid 130 and the cover 140 may be physically separated from each other. For example, a gap G may be formed between the second lid face 132 and the first cover face 141.

In another example embodiment, the second lid face 132 and the first cover face 141 may be in contact with each other, and the lid 130 and the cover 140 may not be physically restrained to each other. Here, when the lid 130 and the cover 140 are not physically restrained, it means that a state of the lid 130 and the cover 140 may be changed from a state of being in contact with each other to a state of being separated from each other in response to an external force (e.g., a force by the manipulation instrument) being applied to the lid 130 and the cover 140.

In another example embodiment, an adhesive portion may be formed between the second lid face 132 and the first cover face 141. The adhesive portion may be configured to bond the second lid face 132 and the first cover face 141. When an external force is applied to the lid 130 and the cover 140, the bonding between the second lid face 132 and the first cover face 141 may be released, and the first cover face 141 may be separated from the second lid face 132.

In an example embodiment, a distance between the second lid face 132 and the first cover face 141 (e.g., a size of the gap G) may be substantially equal to or less than a distance between the first cover face 141 and the second cover face 142 (e.g., a thickness of the cover 140). For example, the distance between the first cover face 141 and the second cover face 142 may be an average of distances in various ranges between the first cover face 141 and the second cover face 142. For example, the distance between the second lid face 132 and the first cover face 141 may be in the range of about 100 μm to about 300 μm, and the distance between the first cover face 141 and the second cover face 142 may be in the range of about 100 μm to about 300 μm. For example, the distances may be determined by an elasticity of the cover 140 and a pressure difference between a pressure on the first cover face 141 and a pressure on the second cover face 142. According to the structure as described above, while a desired amount of material is extracted (e.g., sampled) from the inside of the container 110, leakage of the material remaining inside the container 110 to the outside of the container 110 through the perforation 134 formed in the fragile area 133 may be suppressed or delayed.

In other words, in a material transfer path from the inside of the container 110 via the perforation 134 to the outside of the container 110, a cross-section of a first path portion P1 between the second lid face 132 and the first cover face 141 may be less than a cross-section of a second path portion P2 other than the first path portion P1 (e.g., a path portion on the second cover face 142). A transfer rate of the material in the first path portion P1 may be greater than a transfer rate of the material in the second path portion P2, and a pressure in the first path portion P1 may be less than a pressure in the second path portion P2. Since the pressure on the second cover face 142 is greater than the pressure on the first cover face 141, the cover 140 may cover the perforation 134 formed in the fragile area 133 by a mechanical principle (e.g., Bernoulli's law).

In some example embodiments, the first distance between the second lid face 132 and the first cover face 141 (e.g., the size of the gap G) may be less than the second distance between the first cover face 141 and the second cover face 142 (e.g., the thickness of the cover 140). As an example, in a situation in which the cover 140 is expected to sag relatively greatly by its weight since a density of a material of the cover 140 or a density of a material used to coat the first cover face 141 and/or the second cover face 142 with is relatively high, the effect of sealing the cover 140 with respect to the perforation 134 may improve. As another example, in a situation in which a net force for the cover 140 is expected to be relatively small in one direction (e.g., upward direction) since a vapor pressure in the container 110 is relatively low, the effect of sealing the cover 140 with respect to the perforation 134 may improve. As still another example, in a situation in which a displacement of the cover 140 with respect to a net force is expected to be small since a material property (e.g., Young's modulus) of at least a portion (e.g., an extension 145) of the cover 140 is relatively great, the effect of sealing the cover 140 with respect to the perforation 134 may improve.

In another example embodiment, the first distance between the second lid face 132 and the first cover face 141 (e.g., the size of the gap G) may be greater than the second distance between the first cover face 141 and the second cover face 142 (e.g., the thickness of the cover 140). As an example, when at least a portion of the cover 140 is coated with a relatively thick protective material (e.g., a coating layer) and/or when a magnetic material is positioned on at least a portion of the cover 140, the first distance may be greater than the second distance for sealing. As another example, when a gap between the second lid face 132 and the first cover face 141 is to be secured to prevent damage to the cover 140 by an instrument (e.g., a needle) forming the perforation 134, the first distance may be greater than the second distance for sealing. In order to make the first distance greater than the second distance, for example, the cover 140 may be configured to include a material having a small weight relative to the volume occupied by the cover 140 and a high strain rate.

As described above, the distance between the second lid face 132 and the first cover face 141 (e.g., the size of the gap G) and/or the distance between the first cover face 141 and the second cover face 142 (e.g., the thickness of the cover 140) may be determined by a material property (e.g., Young's modulus) of the lid 130, the cover 140, the connector 150, and/or the protrusion 160 and/or a net force applied thereto.

Figure 3:
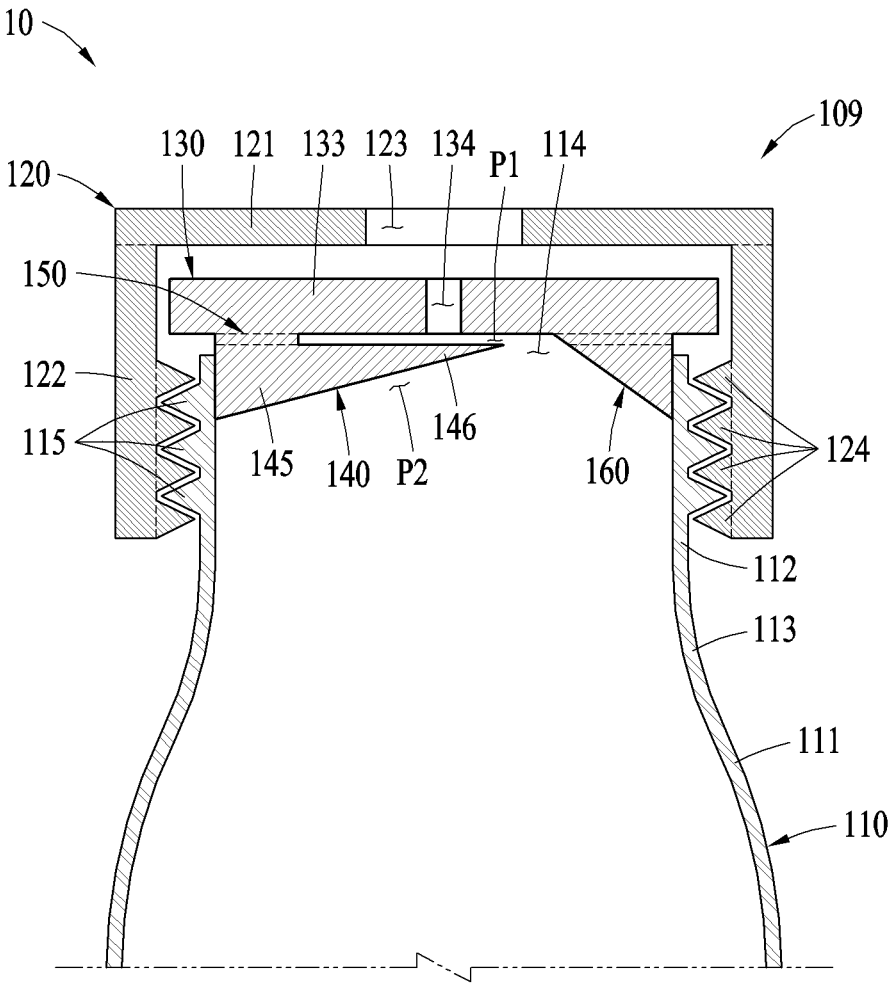
FIG. 3 is a cross-sectional view of a container of FIG. 1 viewed along a line 3-3.
Figure 4:
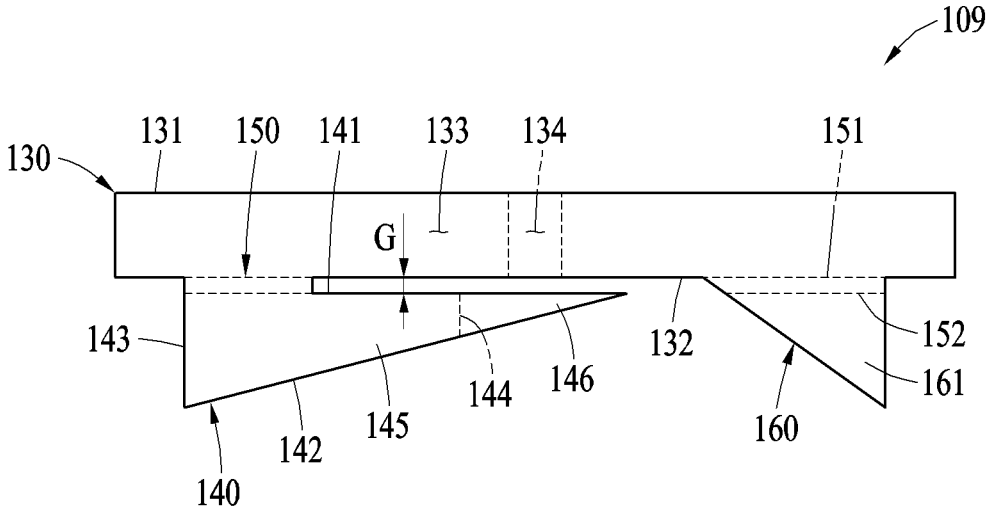
FIG. 4 is a view schematically illustrating a sealing structure according to an example embodiment.

In an example embodiment, the cover 140 may include a first end portion 143, a second end portion 144 opposite to the first end portion 143, and the extension 145 extending between the first end portion 143 and the second end portion 144. The extension 145 may extend along the second lid face 132 and cover at least a portion of the fragile area 133. The extension 145 may cover the perforation 134 to be formed in the fragile area 133. The extension 145 may have the first cover face 141 and the second cover face 142. The first cover face 141 of the extension 145 may be connected to the connector 150. An extending direction of the extension 145 may be, for example, a radial direction of the lid 130 and/or the container 110. Meanwhile, FIGS. 3 and 4 show the extension 145 as if it has a length insufficient to cover the perforation 134 to be formed in the fragile area 133. However, unlike the drawings, the extension 145 may be construed as extending in length sufficient to cover the perforation 134.

In an example embodiment, the extension 145 may have a cantilever structure. For example, the extension 145 may flexibly deform based on the first end portion 143. When the extension 145 deforms, at least a portion of the first cover face 141 of the extension 145 may cover the perforation 134 to be formed in the fragile area 133.

In an example embodiment, a thickness of the extension 145 may vary along the extending direction of the extension 145. For example, when viewing the extension 145 in a direction from the first end portion 143 toward the second end portion 144, the thickness of the extension 145 may decrease linearly. The thickness of the extension 145 may be, for example, in the range of about 100 μm to about 300 μm. As another example, the thickness of the extension 145 may decrease exponentially. As still another example, when viewing the extension 145 in a direction from the first end portion 143 toward the second end portion 144, the thickness of the extension 145 may increase. In another example embodiment, the thickness of the extension 145 may be substantially the same along the extending direction of the extension 145.

In an example embodiment, a width of the extension 145 may vary along the extending direction of the extension 145. For example, when viewing the extension 145 in a direction from the first end portion 143 toward the second end portion 144, the width of the extension 145 may decrease linearly. As another example, the width of the extension 145 may decrease exponentially. As still another example, when viewing the extension 145 in a direction from the first end portion 143 toward the second end portion 144, the width of the extension 145 may increase. In another example embodiment, the width of the extension 145 may be substantially the same along the extending direction of the extension 145.

In an example embodiment, the cover 140 may include a seat 146 configured to seat on the second lid face 142. The seat 146 may be connected to the second end portion 144. The seat 146 may cover the perforation 134 to be formed in the fragile area 133. In an example, the seat 146 may have a substantially circular cross-section. In an example, a diameter of the seat 146 may be greater than the width of the extension 145. In another example, the seat 146 may have a polygonal cross-section.

In an example embodiment, a width of the seat 146 may vary along a direction away from the second end portion 144. For example, when viewing the seat 146 in a direction away from the second end portion 144, the width of the seat 146 may decrease linearly. As another example, the width of the seat 146 may decrease exponentially. As still another example, when viewing the seat 146 in a direction away from the second end portion 144, the width of the seat 146 may increase. In an example embodiment, a variable gradient of the seat 146 may be substantially equal to a variable gradient of the extension 145.

In an example embodiment, the extension 145 and the seat 146 may be seamlessly integrally formed.

The connector 150 may be configured to connect the lid 130 and the cover 140. In an example embodiment, the connector 150 may include a first connecting face 151 (e.g., the top face of the connector 150) connected to the second lid face 132, and a second connecting face 152 (e.g., the bottom face of the connector 150) opposite to the first connecting face 151 and connected to the first cover face 141 and/or the protrusion 160. The connector 150 may be substantially annular, for example.

In an example embodiment, the connector 150 may have a thickness smaller than the thickness of the cover 140 (e.g., the thickness of the extension 145). For example, the thickness of the connector 150 may be substantially equal to the distance (e.g., the gap G) between the second lid face 132 and the first cover face 141. The connector 150 may restore the extension 145 and/or the seat 146 to its original position when the extension 145 and/or the seat 146 deforms toward the inside of the container 110 in response to an external force being applied to the cover 140, for example, by an external manipulation instrument.

The protrusion 160 may protrude from the lid 130 or the connector 150. For example, the protrusion 160 may be formed on the second lid face 132 or the second connecting face 152. The protrusion 160 may suppress or delay deformation or recession of the lid 130 and/or the cover 140 toward the inside of the container 110 and prevent damage to the cover 140 by an external manipulation instrument when an external force is applied to the lid 130 and/or the cover 140.

The protrusion 160 may include a protruding body 161. The protruding body 161 may be substantially annular, for example. In an example embodiment, the protruding body 161 may substantially enclose the seat 146 and/or at least a portion of the extension 145. In an example embodiment, one portion of the protruding body 161 may be connected to one portion of the extension 145, and the other portion of the protruding body 161 may be connected to the other portion of the extension 145. In an example embodiment, the protruding body 161 may have a width that decreases when viewed along a protruding direction. For example, the width of the protruding body 161 may decrease in a direction away from the second lid face 132 or the second connecting face 152. In an example embodiment, at least a portion of the protruding body 161 may be configured to be in contact with an inner surface of the container 110 (e.g., an inner surface of the neck portion 112). Friction between the protruding body 161 and the inner surface of the container 110 may suppress or delay deformation and/or recession of the lid 130 and/or the cover 140, when an external force is applied to the lid 130 and/or the cover 140.

In an example embodiment, the lid 130, the cover 140, the connector 150, and the protrusion 160 may be formed of substantially the same material. In another example embodiment, at least one component of the lid 130, the cover 140, the connector 150, and the protrusion 160 may be formed of a material different from that of the other components.

In an example embodiment, the lid 130, the cover 140, the connector 150, and the protrusion 160 may be seamlessly integrally formed. In another example embodiment, at least one component of the lid 130, the cover 140, the connector 150, and the protrusion 160 may be formed independently of the other components.

Figure 5A:
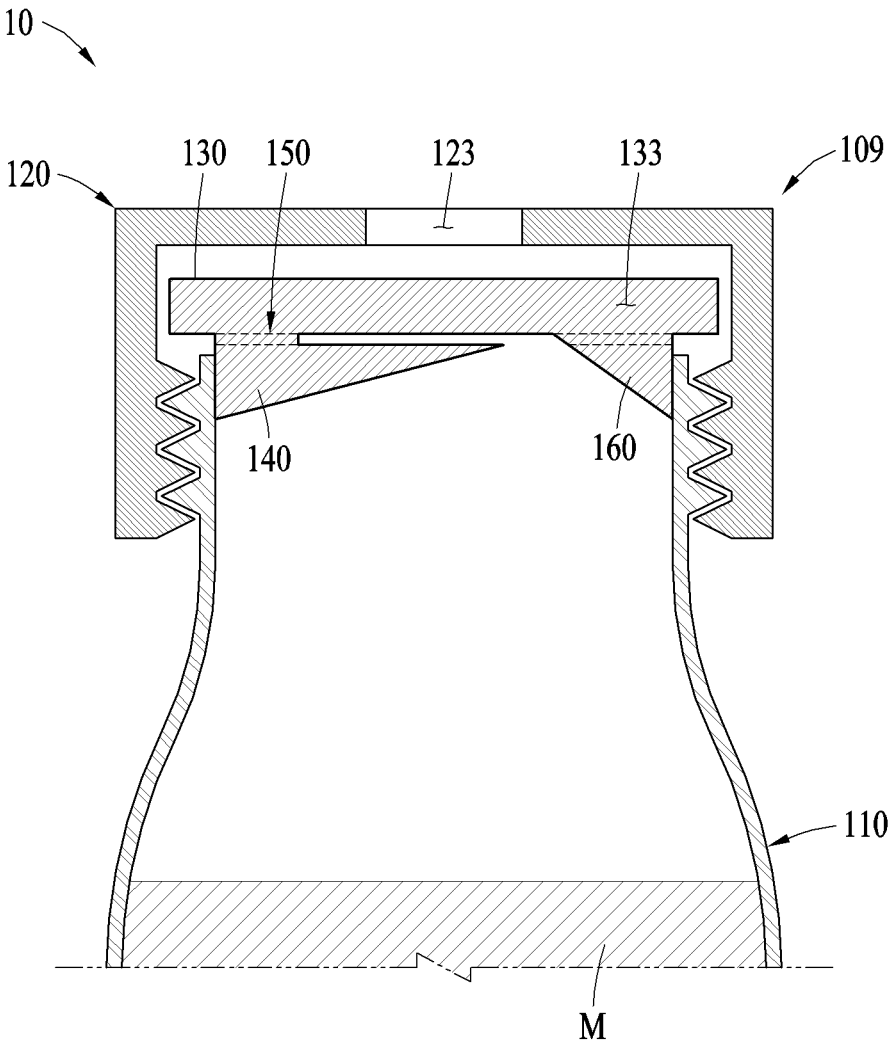
FIGS. 5A, 5B and 5C are cross-sectional views illustrating an operation of a sealing structure in a material containing device according to an example embodiment.
Figure 5B:
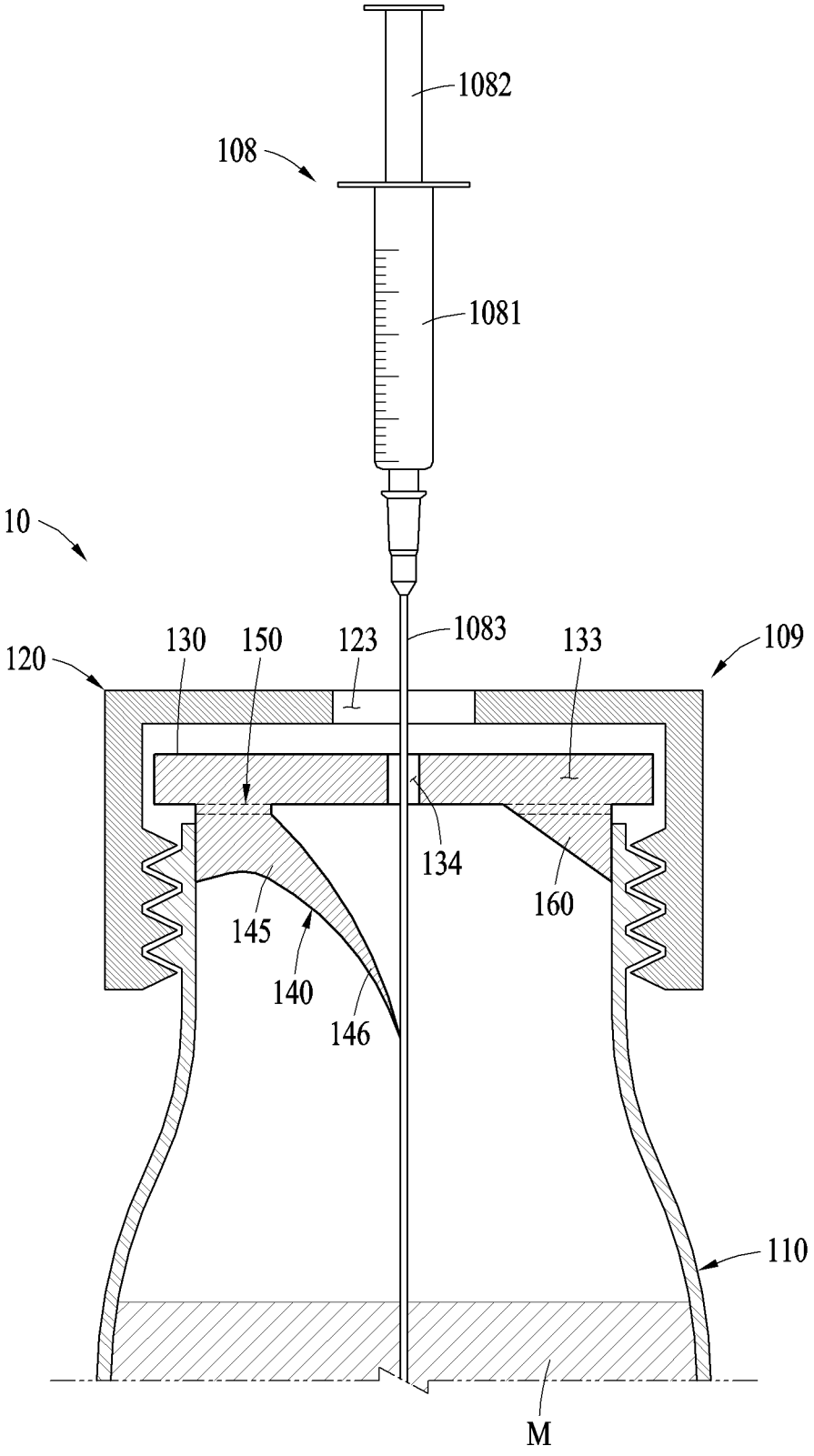
Figure 5C:
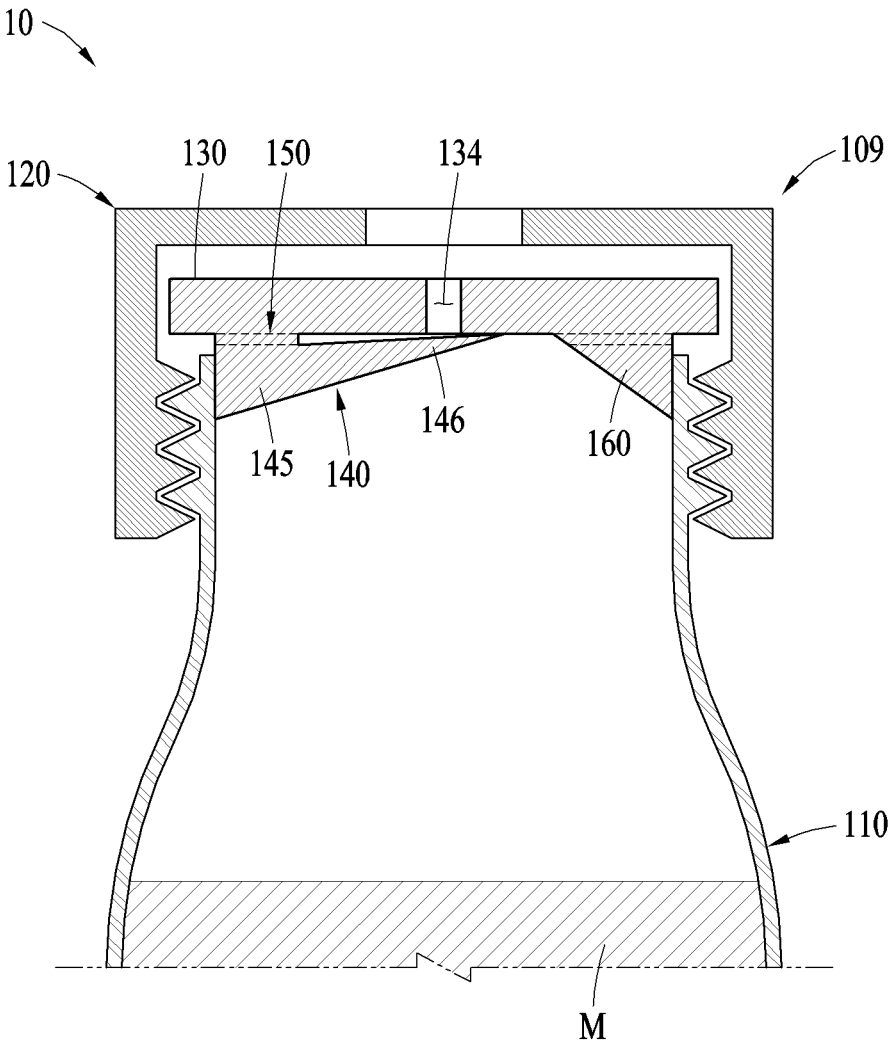

FIGS. 5A, 5B and 5C are views schematically illustrating an example of using the material containing device 10.

FIG. 5A shows the material containing device 10 including the container 110 accommodating a material M and the sealing structure 109 sealing the container 110. Referring to FIG. 5A, the sealing structure 109 may include the cap 120 including the access opening 123, the lid 130 including the fragile area 133, the cover 140 covering at least a portion of the fragile area 133, the connector 150 connecting the lid 130 and the cover 140, and the protrusion 160 protruding from the connector 150 to be in contact with the inner surface of the container 110.

FIG. 5B shows an example of extracting a desired amount of the material M in the container 110 from the material containing device 10 using a sampling instrument 108 for extracting the material M. Referring to FIG. 5B, the sampling instrument 108 may include, for example, a syringe including a syringe body 1081, a push rod 1082, and a needle 1083. The needle 1083 may access the fragile area 133 of the lid 130 through the access opening 123 as the push rod 1082 is pushed, and break the fragile area 133 as penetrating through the fragile area 133. The perforation 134 may be formed in a portion of the fragile area 133 through which the needle 1083 has passed. When the needle 1083 meets the seat 146 and then pushes the seat 146, the extension 145 may be bent, and a movement path of the needle 1083 may be secured. The protrusion 160 may suppress deformation and/or recession of the lid 130 and/or the cover 140 toward the inside of the container 110 by a force applied to the lid 130 when the needle 1083 breaks the fragile area 133. The desired amount of material M may be extracted through the needle 1083 as the push rod 1082 is pulled back, and the material M may be stored in the syringe body 1081.

FIG. 5C shows the material containing device 10 from which a manipulation instrument for extracting the material M (e.g., the sampling instrument 108 of FIG. 5B) is removed. Referring to FIG. 5C, since a pressure in the path portion between the lid 130 and the cover 140 is less than a pressure in the path portion between the cover 140 and the inside of the container 110, the extension 145 may be restored to its original position by the connector 150, and the seat 146 may cover the perforation 134. Since the seat 146 covers the perforation 134, leakage of the material M remaining inside the container 110 to the outside of the container 110 through the perforation 134 may be suppressed or delayed, whereby the perforation 134 may be sealed.

Figure 6:
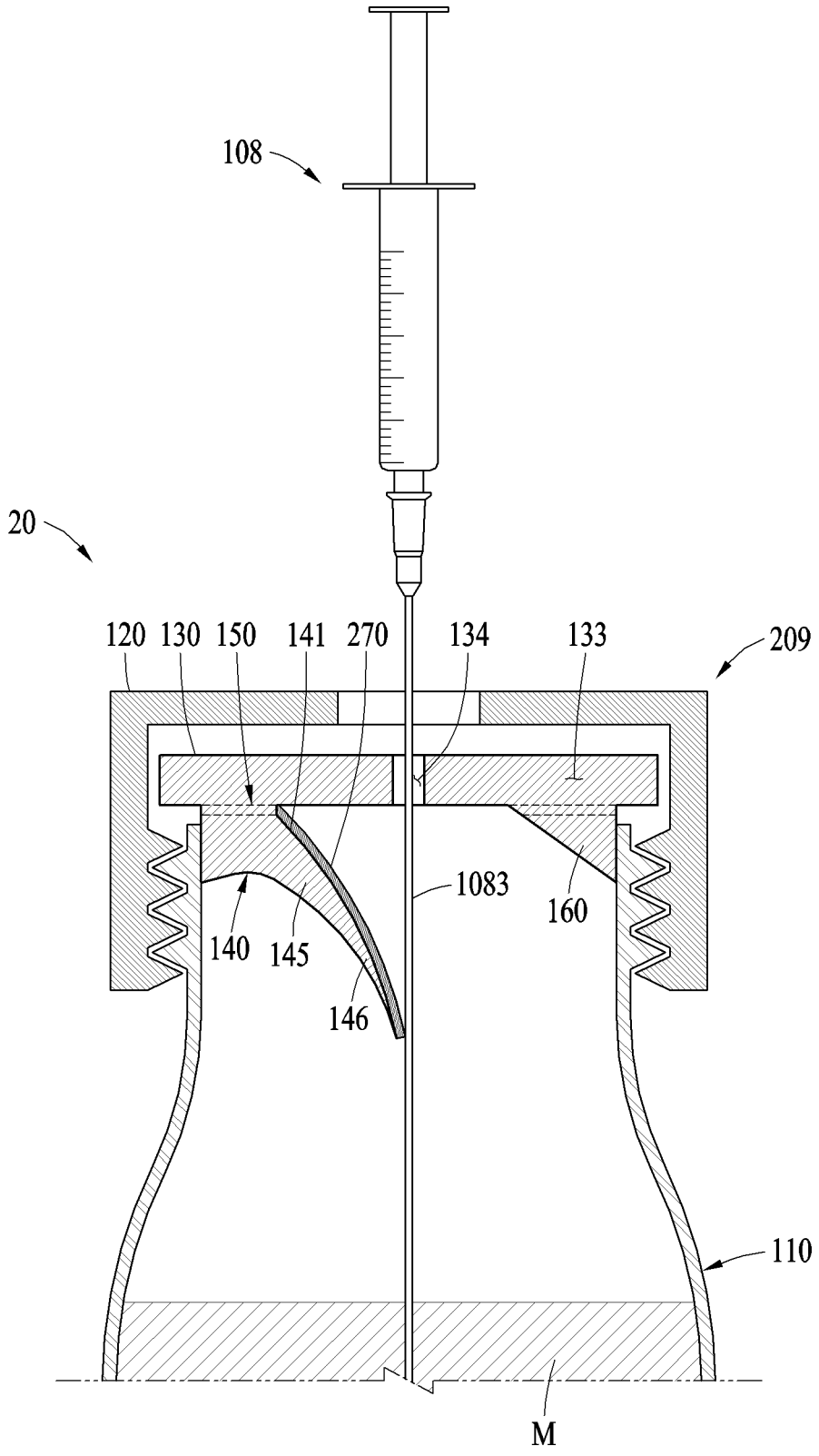
FIG. 6 is a cross-sectional view of a material containing device according to an example embodiment.

Referring to FIG. 6, a material containing device 20 according to an example embodiment may include a container 110 and a sealing structure 209. The sealing structure 209 may be similar to the sealing structure 109 of FIGS. 1 to 4. The sealing structure 209 may include a cap 120, a lid 130 including a fragile area 133, a cover 140 having a first cover face 141 and including an extension 145 and a seat 146, a connector 150, a protrusion 160, and a coating layer 270.

In an example embodiment, the coating layer 270 may be formed on at least a portion of the first cover face 141. For example, the coating layer 270 may be formed on the first cover face 141 of the extension 145 and the seat 146. As another example, the coating layer 270 may be formed on the first cover face 141 of the seat 146. The coating layer 270 may prevent a portion of the cover 140 (e.g., the extension 145 and/or the seat 146) from being damaged or penetrated by a needle 1083 of a sampling instrument 108 when the needle 1083 forms a perforation 134 in the fragile area 133 as penetrating through the fragile area 133 and is pushed toward the inside of the container 110 accommodating a material M. The coating layer 270 may be formed of any material appropriate for reducing friction with the needle 1083 and improving a strength of the first cover face 141.

Figure 7:
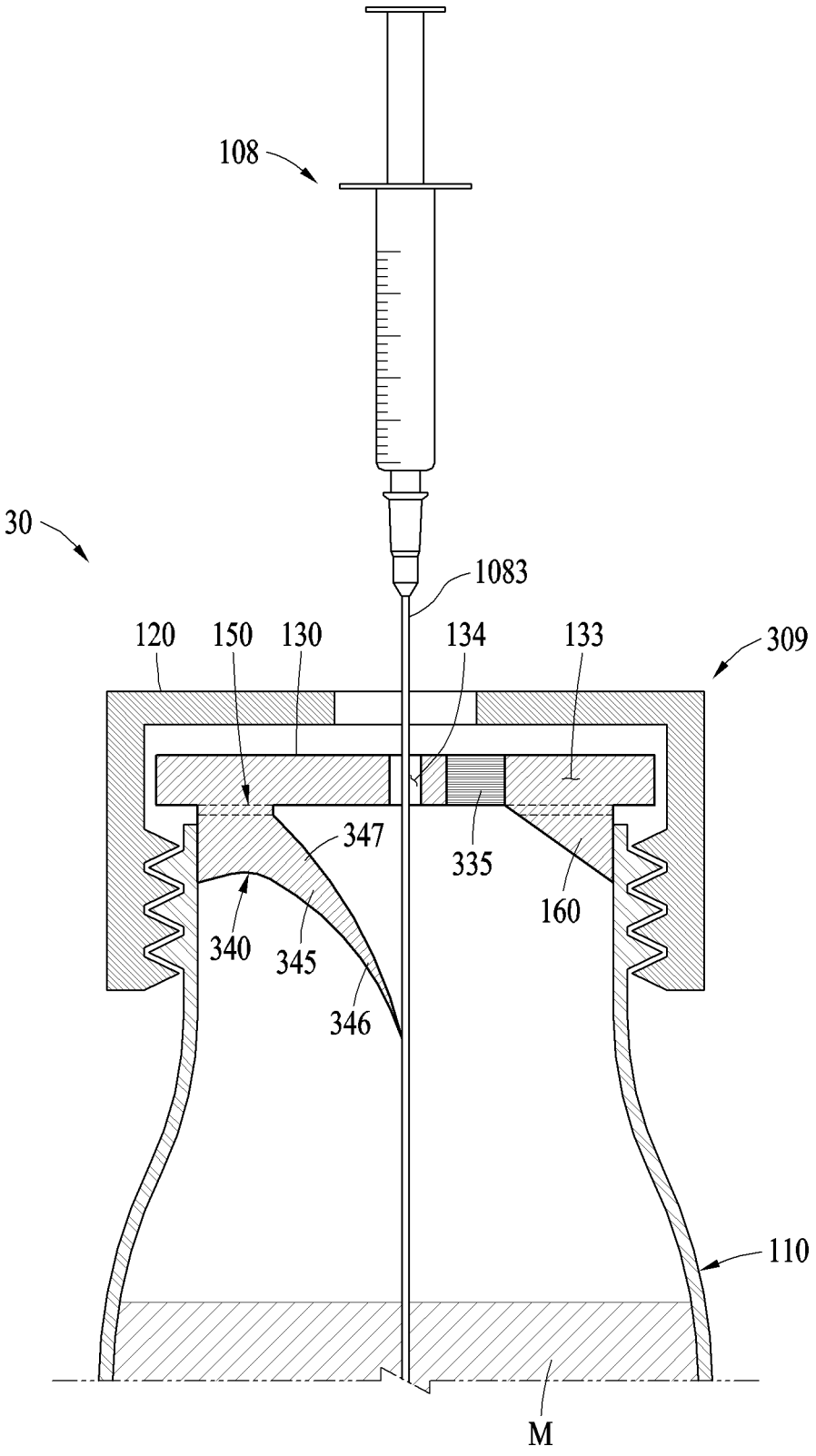
FIG. 7 is a cross-sectional view of a material containing device according to an example embodiment.

Referring to FIG. 7, a material containing device 30 according to an example embodiment may include a container 110 accommodating a material M, and a sealing structure 309 configured to seal the container 110. The sealing structure 309 may be similar to the sealing structure 109 of FIGS. 1 to 4. The sealing structure 309 may include a cap 120, a lid 330, a cover 340, a connector 150, and a protrusion 160.

In an example embodiment, the lid 330 may include a fragile area 133 and a first pole element 335 positioned in the fragile area 133. The first pole element 335 may be configured to exhibit a first polarity (e.g., north (N) pole or south (S) pole). For example, the first pole element 335 may include any electrifiable material appropriate for exhibiting the first polarity. As another example, the first pole element 335 may be formed of a material having a magnetic property (e.g., ferromagnetism).

In an example embodiment, the cover 340 may include an extension 345, a seat 346, and a second pole element 347. The second pole element 347 may be configured to exhibit a second polarity (e.g., S pole or N pole) opposite to the first polarity to be magnetically coupled to the first pole element 335. For example, the second pole element 347 may include any electrifiable material appropriate for exhibiting the second polarity. As another example, the second pole element 347 may be formed of a material having a magnetic property (e.g., ferromagnetism).

In an example embodiment, the second pole element 347 may be positioned across the extension 345 and the seat 346. In another example embodiment, the second pole element 347 may be positioned on one of the extension 345 and the seat 346.

In an example embodiment, the lid 330 and the cover 340 may be formed of substantially the same material.

The magnetic coupling of the first pole element 335 and the second pole element 347 may increase a restoring force of the connector 150 to restore the extension 345 and the seat 346 to their original positions when a needle 1083 of a sampling instrument 108 forms a perforation 134 in the fragile area 133 as penetrating through the fragile area 133, is pushed toward the inside of the container 110 accommodating the material M, and then is pulled back after a desired amount of material M is extracted.

Although an example in which the first pole element 335 and the second pole element 347 are magnetically coupled to each other has been described above, example embodiments are not limited thereto. The first pole element 335 may not be positioned in the fragile area 133 but in another component (e.g., the cap 120) or an external system of the material containing device 30.

Figure 8:
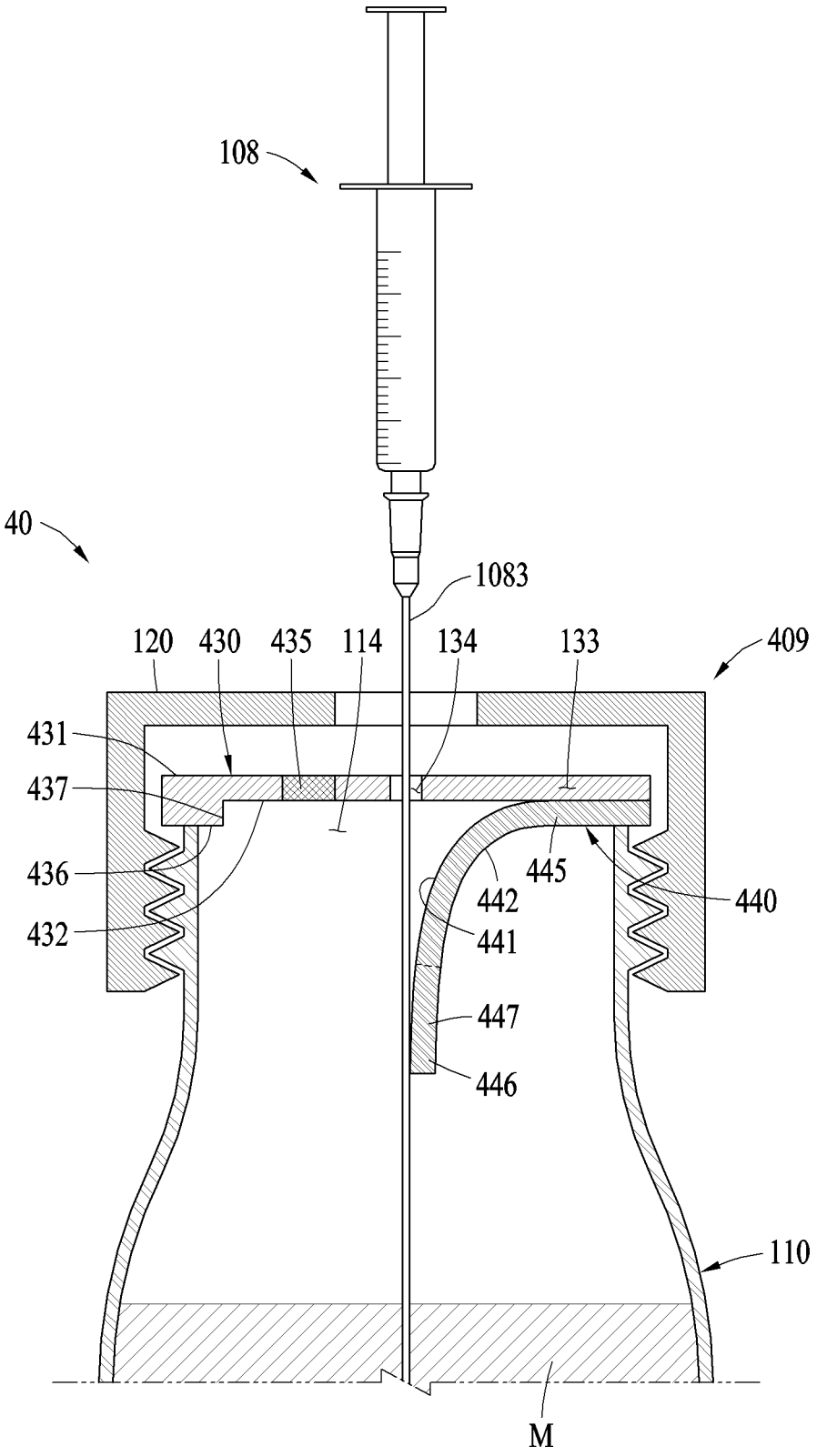
FIG. 8 is a cross-sectional view of a material containing device according to an example embodiment.

Referring to FIG. 8, a material containing device 40 according to an example embodiment may include a container 110 accommodating a material M, and a sealing structure 409 configured to seal the container 110. The sealing structure 309 may be similar to the sealing structure 109 of FIGS. 1 to 4. The sealing structure 409 may include a cap 120, a lid 430, and a cover 440.

In an example embodiment, the lid 430 may include a first lid face 431, a second lid face 432 opposite to the first lid face 432, and a third lid face 436 opposite to the first lid face 432 and non-planar with respect to the second lid face 432. A fragile area 133 may be positioned between the first lid face 431 and the second lid face 432. The third lid face 436 may be positioned on an end portion of the container 110 defining an opening 114. The lid 430 may include a stepped portion 437 formed between the second lid face 432 and the third lid face 436.

In an example embodiment, the lid 430 may include a first pole element 435 (e.g., the first pole element 335 of FIG. 7). The first pole element 435 may be positioned in the fragile area 133.

In an example embodiment, the cover 440 may include a first cover face 441 facing the second lid face 432, and a second cover face 442 opposite to the first cover face 441. In an example embodiment, the first cover face 441 may be configured such that at least a portion of the first cover face 441 is in contact with or fixed to the second lid face 432, and the remaining portion of the first cover face 441 is separated from the second lid face 432. At least a portion of the second cover face 442 may be positioned on the end portion of the container 110 defining the opening 114.

In an example embodiment, the cover 440 may be configured to be in contact or out of contact with the second lid face 432, and not to contact the third lid face 436.

In an example embodiment, the cover 440 may include an extension 445 connected directly to the second lid face 432, and a seat 446 connected to the extension 445. In another example embodiment, a connecting structure (e.g., the connector 150 of FIGS. 2 to 4) may be positioned between the second lid face 432 and the first cover face 441 of the extension 445.

In an example embodiment, the cover 440 may include a second pole element 447 configured to be magnetically coupled with the first pole element 435. The second pole element 447 may be positioned over the extension 445 and the seat 446. In another example embodiment, the second pole element 447 may be positioned on one of the extension 445 and the seat 446.

In an example embodiment, the lid 430 and the cover 440 may be formed of different materials.

The magnetic coupling of the first pole element 435 and the second pole element 447 may increase a restoring force of the cover 440 to restore the extension 445 and the seat 446 to their original positions when a needle 1083 of a sampling instrument 108 forms a perforation 134 in the fragile area 133 as penetrating through the fragile area 133, is pushed toward the inside of the container 110 accommodating the material M, and then is pulled back after a desired amount of material M is extracted.

Figure 9A:
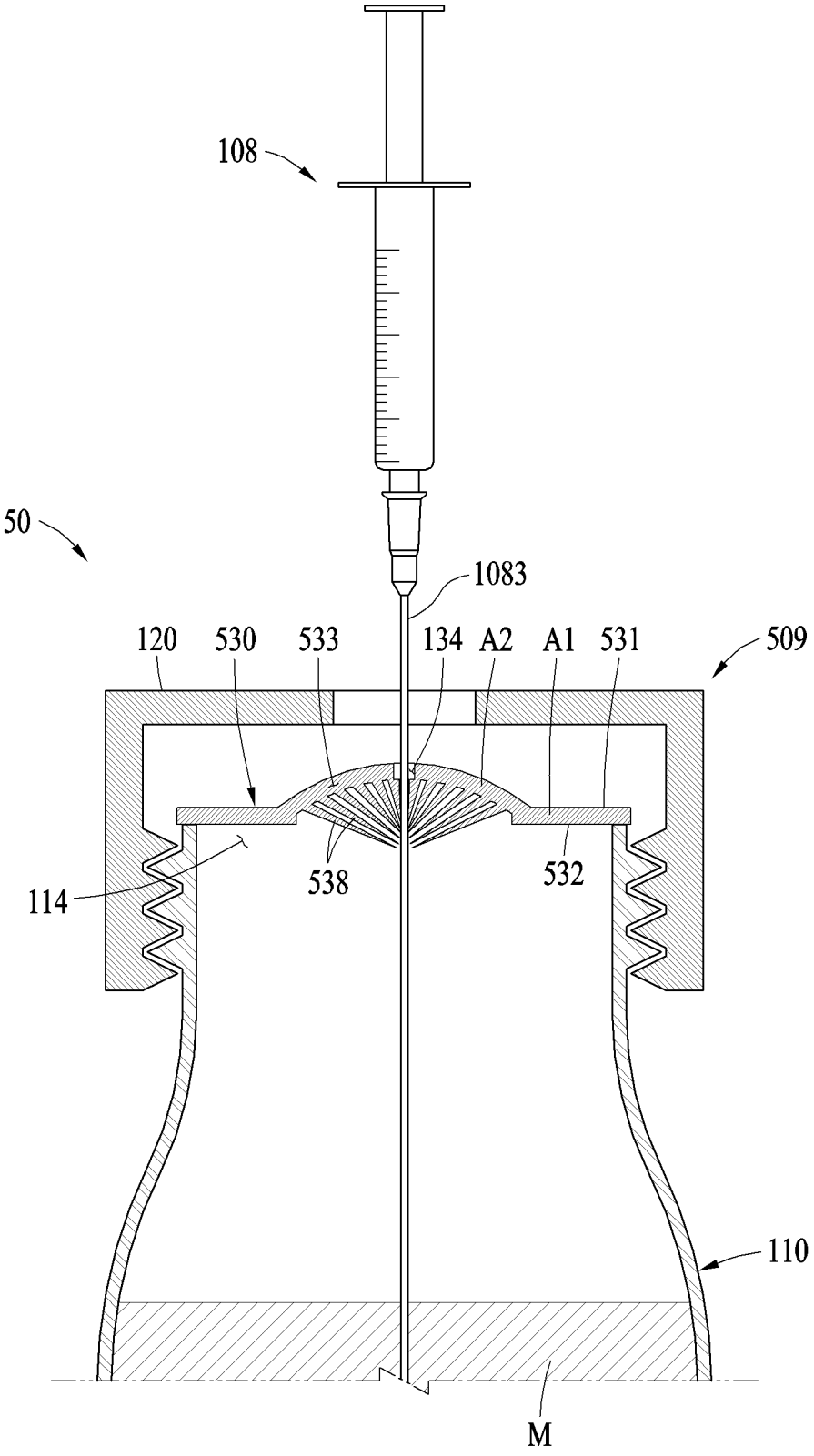
FIG. 9A is a cross-sectional view of a first shape of a sealing structure in a material containing device according to an example embodiment.
Figure 9B:
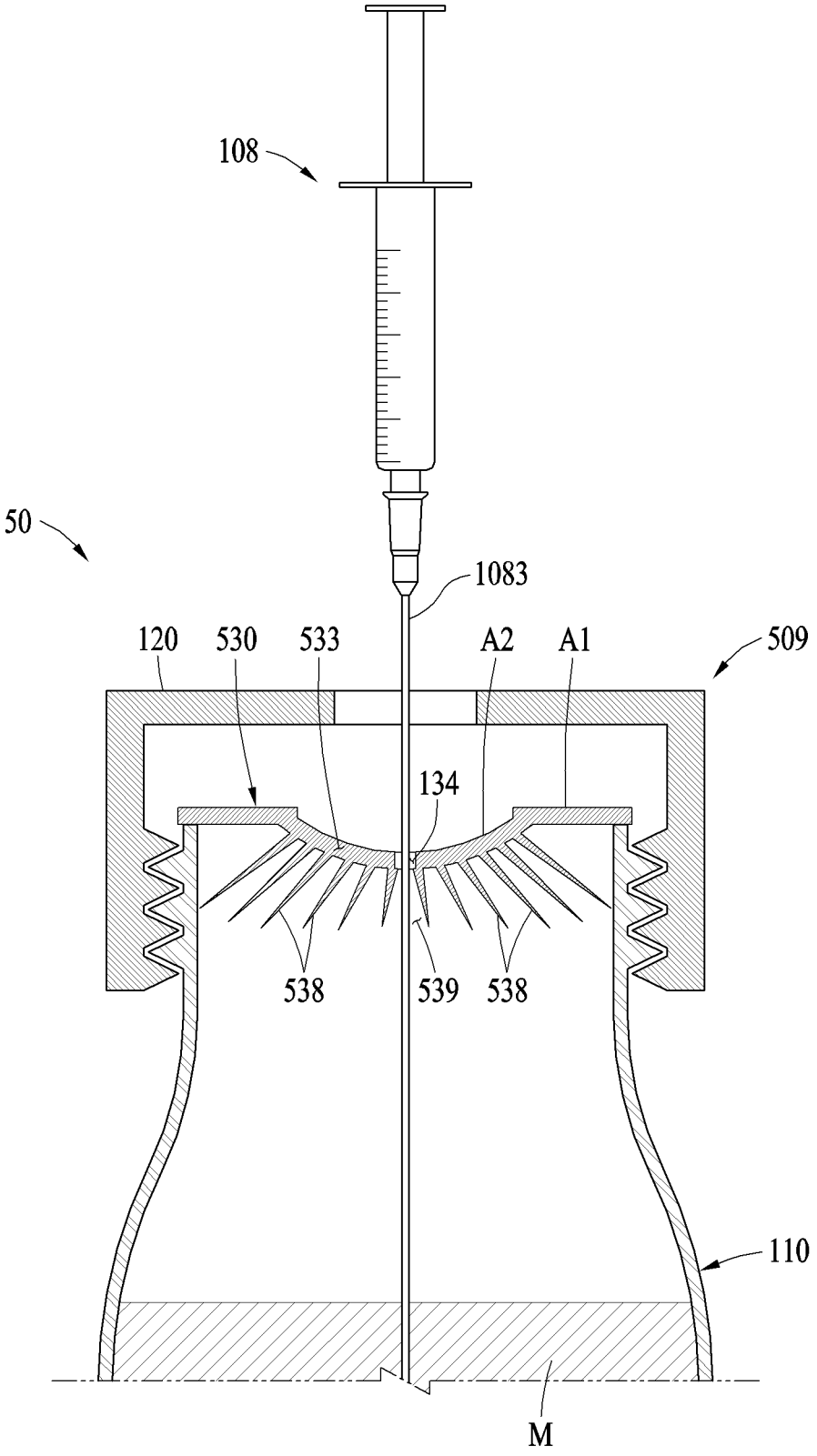
FIG. 9B is a cross-sectional view of a second shape of a sealing structure in a material containing device according to an example embodiment.

Referring to FIGS. 9A and 9B, a material containing device 50 according to an example embodiment may include a container 110 accommodating a material M, and a sealing structure 509 configured to seal the container 110. The sealing structure 509 may include a cap 120 and a lid 530. The lid 530 may include a first lid face 531, a second lid face 532 opposite to the first lid face 531 and facing an opening 114, and a fragile area 533 between the first lid face 531 and the second lid face 532.

In an example embodiment, the lid 530 may include a non-variable area A1 fixed to an end portion of the container 110 defining the opening 114, and a variable area A2 whose shape varies with respect to the non-variable area A1. The non-variable area A1 may maintain a substantially flat shape. The variable area A2 may be configured to be changed in shape between a first shape and a second shape that is different from the first shape. For example, when the variable area A2 is in the first shape, at least a portion of the first lid face 531 may be convex with respect to the non-variable area A1, and at least a portion of the second lid face 532 may be concave with respect to the non-variable area A1. When the variable area A2 is in the second shape, at least a portion of the first lid face 531 may be concave with respect to the non-variable area A1, and at least a portion of the second lid face 532 may be convex with respect to the non-variable area A1.

In an example embodiment, at least a portion of the variable area A2 may include the fragile area 533. In some example embodiments, the fragile area 533 may also be formed in the non-variable area A1.

In an example embodiment, the lid 530 may include a plurality of guides 538, and a plurality of channels 539 each formed between a pair of adjacent guides 538. In an example embodiment, the plurality of guides 538 may be configured to be changed in shape between a first shape and a second shape that is different from the first shape. For example, the plurality of guides 538 may converge or contract when in the first shape while diverge or expand when in the second shape.

In an example embodiment, the plurality of guides 538 may protrude from the second lid face 532. In some example embodiments, the plurality of guides 538 may have a width that decreases along their protruding direction. According to an example embodiment the length of the plurality of guides 538 may vary. According to an example embodiment, a first length of a first guide 538 closer to a center of the lid 530 may be shorter than a second length of a second guide 538 farther from the center of the lid 530 than the first guide 538.

When a needle 1083 of a sampling instrument 108 breaks the fragile area 533 of the variable area A2 of the lid 530, forms a perforation 134 in the fragile area 533, and is pushed toward the material M in the container 110, the variable area A2 and the plurality of guides 538 may be changed in shape from the first shape to the second shape, and a pair of guides 538 adjacent to the needle 1083 may guide the needle 1083 to be pushed therebetween. When the needle 1083 extracts the material M and is pulled back, the variable area A2 and the plurality of guides 538 may be changed in shape from the second shape to the first shape, and the pair of guides 538 adjacent to the needle 1083 may guide the needle 1083 to be pulled back therebetween. The elastic shape change of the variable area A2 and/or the shape change in the plurality of guides 538 may seal the perforation 134 to be formed as the needle 1083 is pulled back.

In another example embodiment, the variable area A1 may remain substantially flat in the first shape, and the plurality of guides 538 may remain substantially parallel to each other in the first shape.

Figure 10:
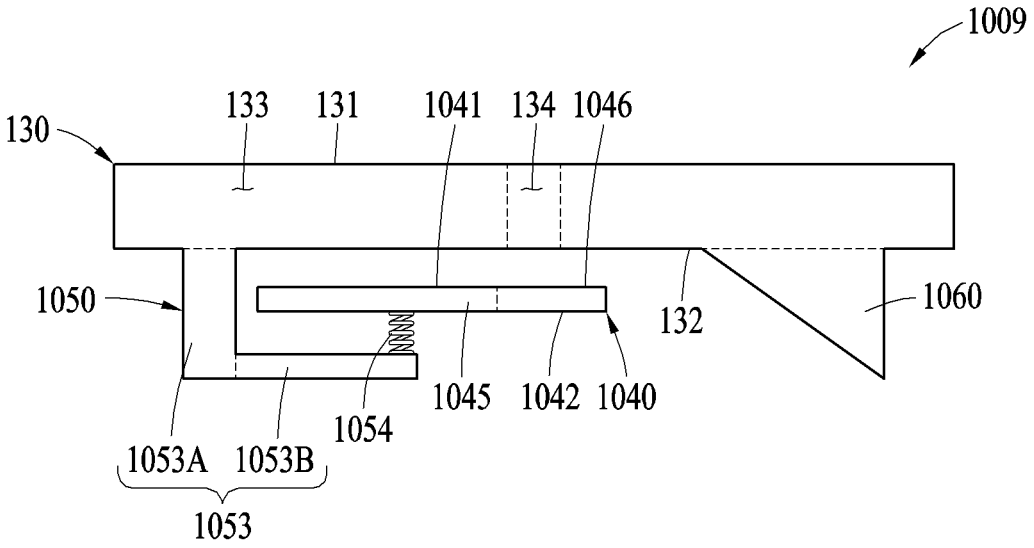
FIG. 10 is a view schematically illustrating a sealing structure according to an example embodiment.

Referring to FIG. 10, a sealing structure 1009 according to an example embodiment may include a lid 130, a cover 1040, a connector 1050, and a protrusion 1060. The lid 130 may include a first lid face 131, a second lid face 132, and a fragile area 133. When the fragile area 133 is broken, a perforation 134 may be formed in the fragile area 133. The protrusion 1060 may protrude from the second lid face 132.

In an example embodiment, the cover 1040 may include an extension 1045 having a first cover face 1041 and a second cover face 1042 and/or a seat 1046 having the first cover face 1041 and the second cover face 1042. A distance between the first cover face 1041 and the second cover face 1042 (e.g., a thickness of the extension 1045 and the seat 1046) may be substantially uniform. In another example embodiment, the distance between the first cover face 1041 and the second cover face 1042 (e.g., the thickness of the extension 1045 and the seat 1046) may vary.

In an example embodiment, the connector 1050 may include a support structure 1053 positioned on the second lid face 132, and an elastic body 1054 connected to the support structure 1053 and the second cover face 1042. The support structure 1053 may be configured to support the elastic body 1054, and the elastic body 1054 may allow the cover 1040 to elastically move with respect to the support structure 1053. The elastic body 1054 may include, for example, a compression spring. According to a mechanical principle, a pressure on the first cover face 1041 is lower than a pressure on the second cover face 1042. Thus, when the cover 1040 moves toward the second lid face 132, the elastic body 1054 may increase a restoring force of the cover 1040, and the degree of sealing of the perforation 134 by the cover 1040 may increase.

In an example embodiment, the support structure 1053 may include a wall portion 1053A extending from the second lid face 132 in a first direction (e.g., a vertical direction in FIG. 10), and a base portion 1053B extending from the wall portion 1053A in a second direction (e.g., a horizontal or radial direction in FIG. 10) intersecting with the first direction. The elastic body 1054 may be connected to one face of the base portion 1053B.

Figure 11:
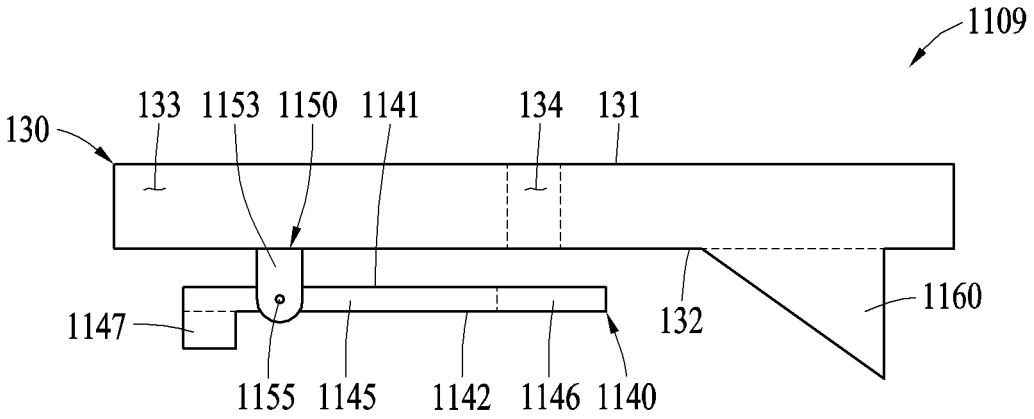
FIG. 11 is a view schematically illustrating a sealing structure according to an example embodiment.

Referring to FIG. 11, a sealing structure 1109 according to an example embodiment may include a lid 130, a cover 1140, a connector 1150, and a protrusion 1160. The lid 130 may include a first lid face 131, a second lid face 132, and a fragile area 133. When the fragile area 133 is broken, a perforation 134 may be formed in the fragile area 133. The protrusion 1160 may protrude from the second lid face 132.

In an example embodiment, the cover 1140 may include an extension 1145 having a first cover face 1141 and a second cover face 1142 and/or a seat 1146 having the first cover face 1141 and the second cover face 1142. A distance between the first cover face 1141 and the second cover face 1142 (e.g., a thickness of the extension 1145 and the seat 1146) may be substantially uniform. In another example embodiment, the distance between the first cover face 1141 and the second cover face 1142 (e.g., the thickness of the extension 1145 and the seat 1146) may vary.

In an example embodiment, the connector 1150 may include a support structure 1153 positioned on the second lid face 132. The support structure 1153 may include a pivot 1155 to which the extension 1145 is rotatably connected. The support structure 1153 may support the extension 1145 such that the extension 1145 is rotatable thereabout. According to a mechanical principle, a pressure on the first cover face 1141 is lower than a pressure on the second cover face 1142. Thus, when the cover 1140 moves toward the second lid face 132, the support structure 1153 may contribute to a rotational movement of the cover 1140, and the rotational movement of the cover 1140 may increase the degree of sealing a perforation 134.

In an example embodiment, the pivot 1155 may be connected at a position offset from a central portion of the extension 1145. In another example embodiment, the pivot 1155 may be connected substantially to the central portion of the extension 1145.

In an example embodiment, the cover 1140 may include a weight 1147 that increases a rotational moment (e.g. torque) of the extension 1145. The weight 1147 may be connected at a position offset from the central portion of the extension 1145. For example, the weight 1147 may be positioned at an end portion apart from the extension 1145 and/or the seat 1146 covering the perforation 134 or at a portion adjacent to the end portion. In an example embodiment, the weight 1147 may be seamlessly integrally formed with the extension 1145.

While example embodiments have been described, it will be apparent to one of ordinary skill in the art that various changes in form and details may be made in these example embodiments without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents.

What is claimed is:

1. A sealing structure comprising:

a lid comprising a first lid face, a second lid face opposite to the first lid face, and a fragile area between the first lid face and the second lid face;

a cover comprising a first cover face facing the second lid face and covering the fragile area, and a second cover face opposite to the first cover face, wherein a first distance of a gap between the second lid face and the first cover face is substantially equal to or less than a second distance between the first cover face and the second cover face; and a connector configured to connect the lid and the cover, wherein the cover further comprises:

a proximal end portion connected to lid through the connector;

a distal end portion opposite to the proximal end portion; and an extension portion extending along the second lid face between the proximal end portion and the distal end portion, wherein the extension portion decreases in thickness from the proximal end portion to the distal end portion, and wherein the gap is maintained from the proximal end portion to the distal end portion.

2. The sealing structure of claim 1, wherein the extension portion is configured to deform based on the proximal end portion.

3. The sealing structure of claim 1, wherein the cover further comprises a seat connected to the distal end portion and configured to contact the second lid face.

4. The sealing structure of claim 3, wherein the second lid face and the seat are separated from each other by a gap therebetween.

5. The sealing structure of claim 3, wherein the second lid face and the seat are configured to be in contact with each other, and wherein the second lid face and the seat are not physically restrained to each other.

6. The sealing structure of claim 3, wherein the cover further comprises an adhesive portion provided between the second lid face and the seat, the adhesive portion being configured to bond the second lid face and the seat.

7. The sealing structure of claim 1, wherein the connector is positioned between the second lid face and the first cover face and the connector has a thickness smaller than the second distance between the first cover face and the second cover face.

8. The sealing structure of claim 1, further comprising:

a protrusion protruding from the second lid face or the connector.

9. The sealing structure of claim 1, wherein the cover further comprises a coating layer provided on the first cover face.

10. The sealing structure of claim 1, wherein the connector comprises:

a support structure provided on the second lid face; and an elastic body connected to the support structure and the second cover face.

11. The sealing structure of claim 10, wherein the support structure comprises:

a wall portion extending from the second lid face in a first direction; and a base portion extending from the wall portion in a second direction intersecting with the first direction to be connected to the elastic body.

12. The sealing structure of claim 1, wherein the connector comprises a support structure provided on the second lid face, the support structure having a pivot to which the cover is rotatably connected.

13. The sealing structure of claim 12, wherein the cover further comprises:

a weight provided on the extension portion.

14. A sealing structure comprising:

a lid comprising a first lid face, a second lid face opposite to the first lid face, a fragile area between the first lid face and the second lid face, and a first pole element provided in the fragile area and configured to exhibit a first polarity; and a cover comprising a first cover face connected to the second lid face, a second cover face opposite to the first cover face, and a second pole element configured to exhibit a second polarity opposite to the first polarity, wherein the first cover face faces the second lid face and overlaps the fragile area, wherein the cover further comprises:

a proximal end portion connected to the lid;

a distal end portion opposite to the proximal end portion; and an extension portion extending along the second lid face between the proximal end portion and the distal end portion, wherein the extension portion decreases in thickness from the proximal end portion to the distal end portion.

15. The sealing structure of claim 14, wherein the lid and the cover are formed of substantially a same material.

16. The sealing structure of claim 14, wherein the lid is formed of a first material and the cover is formed of a second material different from the first material.

17. The sealing structure of claim 14, wherein the extension portion configured to deform based on the proximal end portion.

18. The sealing structure of claim 1, wherein the distal end portion is configured to cover a perforation formed in the fragile area based on Bernoulli's principle.

19. The sealing structure of claim 1, wherein the first distance is based on an elasticity of the cover and a first pressure difference between a pressure on the first cover face and a second pressure on the second cover face.

20. The sealing structure of claim 14, wherein the second pole element is provided in the extension portion.

* * * * *